US008087594B2

(12) United States Patent
Navarro

(10) Patent No.: US 8,087,594 B2
(45) Date of Patent: Jan. 3, 2012

(54) HANDS-FREE DIRECTABLE LOW-PRESSURE AIR SOURCE AND METHOD FOR COSMETOLOGY USE

(75) Inventor: Maria A. Navarro, Houston, TX (US)

(73) Assignee: Novalash, Inc., Houston, TX (US)

( * ) Notice: Subject to any disclaimer, the term of this patent is extended or adjusted under 35 U.S.C. 154(b) by 315 days.

(21) Appl. No.: 12/240,116

(22) Filed: Sep. 29, 2008

(65) Prior Publication Data

US 2010/0078088 A1 Apr. 1, 2010

Related U.S. Application Data

(60) Provisional application No. 60/976,421, filed on Sep. 29, 2007.

(51) Int. Cl.
*B05B 1/00* (2006.01)
*A45D 20/12* (2006.01)

(52) U.S. Cl. ..... 239/153; 239/270; 34/97

(58) Field of Classification Search ..... 239/33, 239/152–154, 270, 290–292, 300, 340, 529, 239/DIG. 21, DIG. 22; 34/96, 97; 132/201, 132/216–218; 222/175
See application file for complete search history.

(56) References Cited

U.S. PATENT DOCUMENTS 3,107,069 A * 10/1963 Draim ..... 244/4 A
3,353,749 A * 11/1967 Lahaug ..... 239/154
2008/0016712 A1 * 1/2008 Van ..... 34/283

* cited by examiner

*Primary Examiner* — Darren W Gorman
(74) *Attorney, Agent, or Firm* — Sherman Pernia

(57) ABSTRACT

Disclosed is a variable air source that provides directional control over a low-pressure airflow. The air source is specifically adapted for use in the application of artificial eyelash extensions to a person's individual eyelashes. An air pump provides low pressure air to an airflow nozzle mounted on the finger of the user. A foot control operates the air pump. The finger nozzle allows the user to direct the airflow without having to grasp the nozzle with the fingers. This allows the user's hands to be free to perform other manual manipulations during the method of adhering artificial eyelash extensions to a person's individual natural eyelashes.

1 Claim, 4 Drawing Sheets

HANDS-FREE DIRECTABLE LOW-PRESSURE AIR SOURCE AND METHOD FOR COSMETOLOGY USE

This application claims the benefit of prior filed U.S. Provisional Application Ser. No. 60/976,421 filed 29 Sep. 2007, the content of which is incorporated herein by reference.

FIELD OF THE INVENTION

The present invention is in the field of cosmetic materials and the education and demonstration of their proper use. More specifically, the present invention relates personal grooming and artificial eyelashes adapted for attachment on hair growing from an eyelid, and apparatuses and methods specifically adapted for use in the application of artificial eyelash extensions to individual natural eyelashes.

BACKGROUND OF THE INVENTION

Applying individual eyelash extensions is a labor-intensive procedure that requires a high level of manual dexterity. An eyelash extensions consist of one or more hairs attached to a person's individual natural eyelash. The lash extension itself may be of human, animal, or synthetic origin. To apply the lash extensions, beauticians and cosmetologists commonly use surgical instruments (such as tweezer forceps), and the application process requires precision as well as manual dexterity in the use of these instruments, typically using the index finger and thumb of the "favored hand."

The beautician will first select an individual eyelash extension from a cache of extensions, then apply an adhesive near the base of an eyelash extension, next apply the eyelash extension, with adhesive, to an individual eyelash that has been individually selected and isolated from surrounding eyelashes. An adhesive is utilized to attach the lash extension to one of the user's natural eyelash. The adhesive consists of a fluid that sets over a short but variable period of time, which typically is in the order of 60 seconds or more. A significant amount of the time incurred during the application process consists of waiting for the adhesive to cure. Further, the beautician must separate the particular eyelash receiving the extension from surrounding eyelashes, as spoils from the adhesive can cause adjoining eyelashes to bond together or unsightly and painful clumps of cured adhesive. Finally, working in close proximity to customer's eye with instruments requires slow and methodical movements of the beautician's hands, further increasing the time required to apply a full set of extensions. A typical application of a complete set of extensions can take an experience beautician between 45 minutes to 2 hours. Beauticians with less dexterity or experience typically take longer.

An object of the present invention is to provide a means for separating individual eyelashes from surrounding eyelashes utilizing an airflow. Another object of the present invention is to provide a source of a low pressure, directable and variable airflow for use to accelerates the setting time of the adhesive. A further and highly useful object of the present invention is to provide a substantially "hands-free" low pressure, directable air flow source, that allows application of lash extensions without having to put down the instruments being used to operate and direct the air flow source. A feature of the present invention is that useful additives to the airflow for functional or aesthetic benefits.

DESCRIPTION OF THE INVENTION

Figure 1:
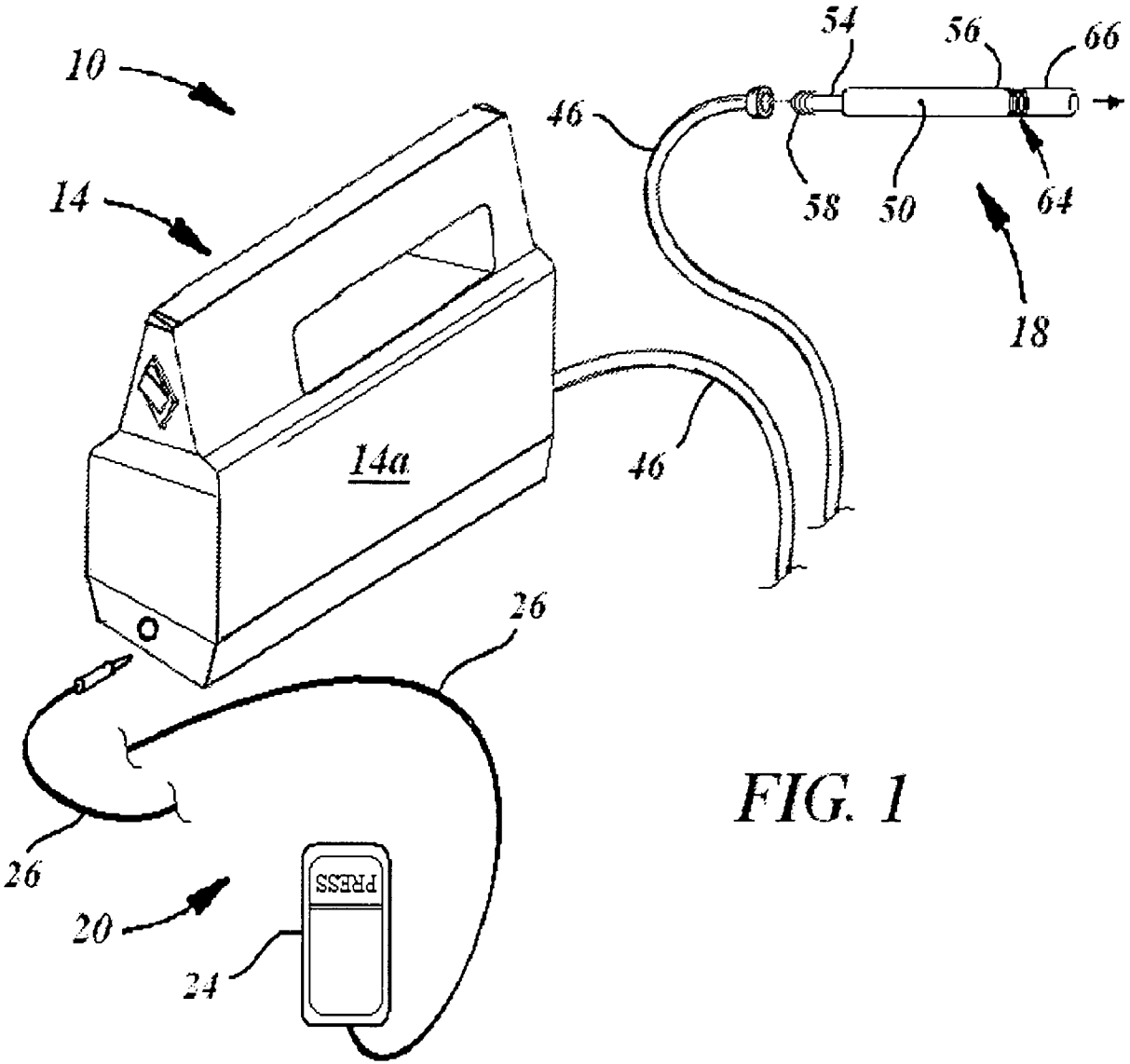
FIG. 1 is a component diagram showing the primary components of the present hands-free, directable low-pressure air source.

Referring now to the drawings, the details of preferred embodiments of the present invention are graphically and schematically illustrated. Like elements in the drawings are represented by like numbers, and any similar elements are represented by like numbers with a different lower case letter suffix.

The present invention relates to an apparatus and method specifically adapted for use in the application of artificial eyelash extensions to a person's individual natural eyelashes. The apparatus is a remotely controllable, hands-free, low-pressure air source having a directable airflow nozzle. The method relates to the use of the remotely controllable, hands-free, low-pressure air source for cosmetology use to substantially reduce the time previously required to apply a full set of individual eyelash extensions to a person's natural lashes. The combination of the apparatus and method of the present invention substantially reduces the amount of time to apply a full set of such individual lash extensions relative to what is currently required in the industry. Note that although the apparatus and method may be described herein for a right-handed user, it is intended and anticipated that the appropriate reverse-handed description is easily inferred from the teachings as applicable for a left-hand user.

As illustrated in FIG. 1, the present hands-free, directable low-pressure air source 10 for cosmetology use comprises: a low pressure airflow source, a remote control unit, an air dispensing unit and the appropriate tubing and cabling to interconnect these components. The present air source 10 is "hands-free" in that a user of the apparatus does not have to use any of his/her dexterity to operate the apparatus. More specifically, the user does not have to use any of his/her fingers to hold the air dispenser 18 component of the air source 10, or to control the flow of air from the dispenser 18. The air source 10 is "directable" in that the air nozzle fitting 66 of the air dispenser 18 may be variably pivoted relative to the barrel 50 of the air dispenser 18 to alter the direction of the air flow expelled from the from the nozzle orifice 68 of the air nozzle 66.

The low pressure air flow source 14 provides gas (air) at a pressure and flow rate appropriate for use in the vicinity of a person's eyes. A typical air-brush compressor 14*a* has proved satisfactory for this purpose. See for example, U.S. Pat. No. 5,088,903. Alternatively, any other source of low pressure air at an appropriate flow rate may be by one of skill in the art for practice in the present invention, such as a house air-line, or a compressed gas bottle 14*b* (see FIG. 6), or any other device that may serve as an appropriate supply or reservoir of low pressure air. Additionally, the air lines 46 of the present invention may be accomplished using such air delivery lines as typical of an air brush apparatus.

A remote control unit 20 is in communication with the air flow source 14. The remote control unit 20 is a mechanism which controls the flow of air passing or supplied from air flow source 14 to the output air-line 46. In FIG. 1, the flow of air is controlled via the remote control unit 20 which in turn operates an air flow valve, which preferably is a normally closed air flow valve. In this embodiment, the remote control unit 20 comprised a foot pedal 24, which includes an electrical connection 26 to the air flow source 14*a*. The foot pedal 24 included an electrical circuit that operated the air flow valve (not shown) inside the electrical compressor type air flow source 14*a*. In an alternative embodiment, the electrical connection 26 could be a wireless electrical connection.

Figure 6:
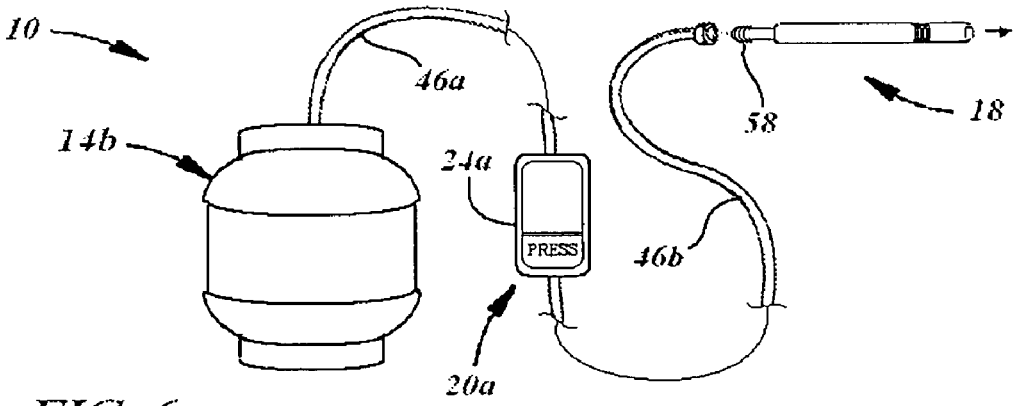
FIG. 6 is a component diagram showing alternative embodiments of the primary components of the present hands-free, directable low-pressure air source.
Figure 7A:
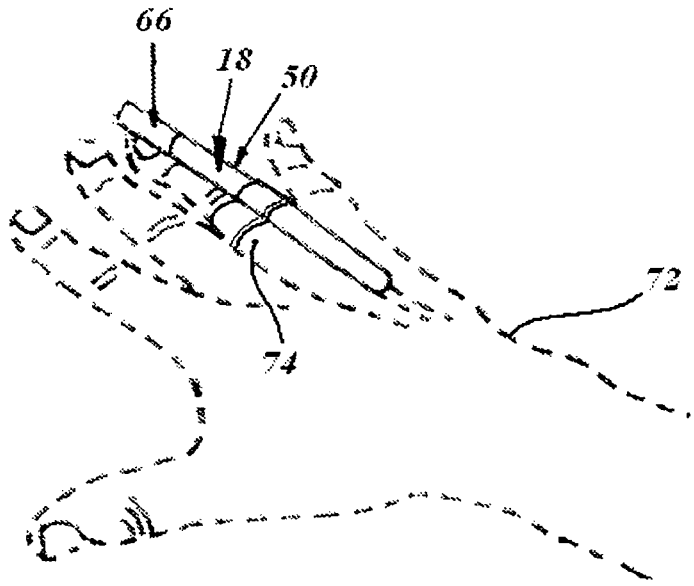
FIGS. 7A and 7B are schematic diagrams of a user's hand (A) in an open configuration and having the nozzle of the present invention mounted on a finger of the hand, and (B) with the index finger and thumb in the working position incorporating the present invention on the ring finger.
Figure 7B:
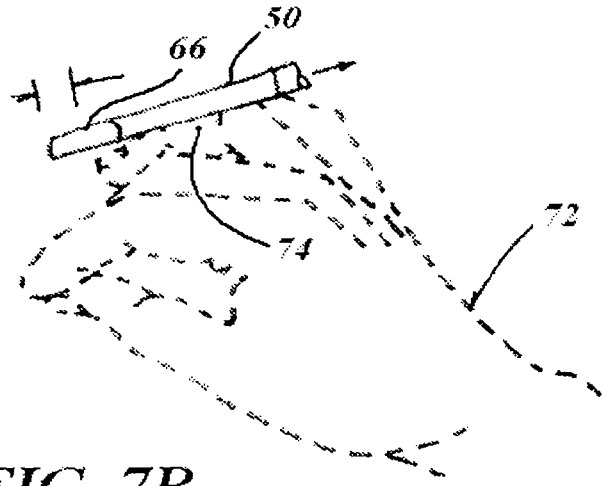

In the embodiment illustrated in FIG. 6, the foot pedal 24*a* is disposed in-line with the output air-line 46, and in direct gas flow communication with the air flow source 14*b* and the air dispenser 18. In FIG. 6, the foot pedal 24*a* of the remote control unit 20*a* controls the output air flow valve via the operation of a graduated foot-pressure switch, both of which are inside the foot pedal 24*a*. Graduated pressure switches suitable for practice in the present invention are known to and selectable by one of ordinary skill in the art for practice in the present invention, in view of the teachings herein.

Figure 2:
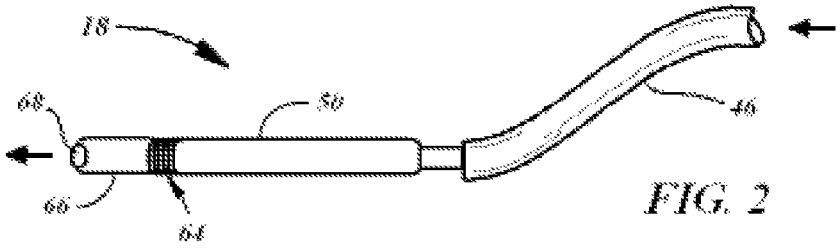
FIG. 2 is a schematic diagram of the air dispensing unit of the hands-free, directable low-pressure air source.
Figure 3:
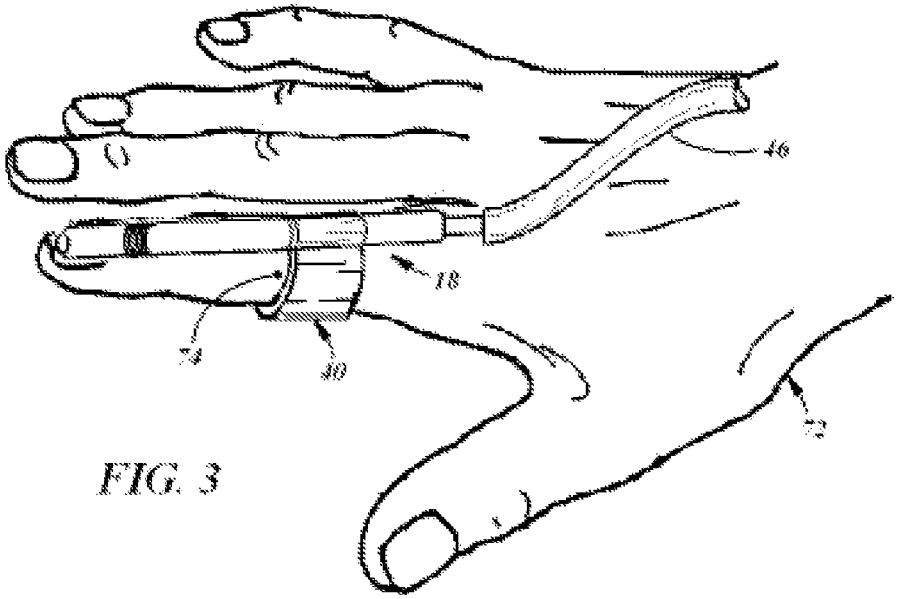
FIG. 3 is a schematic diagram illustrating the air dispensing unit of the hands-free, directable low-pressure air source mounted on the index finger of a user, the mount being a finger ring attached to air dispensing unit of the present invention.

FIGS. 2 and 3 illustrate a preferred embodiment of the air dispenser 18 of the present low pressure air source 10. The air dispenser 18 has a barrel portion 50 having a first gas input end 54 and a nozzle joint end 56. The input end 54 has a gas port 58 that is connectable in gas flow communication to the output air line 46. The nozzle joint end 56 of the barrel 50 terminates in a ported swivel or pivot joint 64. A gas flow passage 60 connects the gas port 58 with the ported joint 64 in gas flow communication. The pivot joint 64 connects the nozzle joint end 56 of the barrel 50 to the nozzle fitting 66 of the air dispenser 18. The pivot joint 64 in the embodiment illustrated is a "crinkled" section of a length of tubing that forms the barrel 50 and/or the nozzle fitting 66, and functions as a pivot much as the similar crinkled section of a common soda straw. The nozzle fitting 66 has a nozzle gas chamber 62 in gas flow communication with the gas flow passage of the barrel 50. The nozzle gas chamber 62 of the nozzle fitting 66 terminates in a gas outflow port 68. The air flow from the outflow port 68 is "directable" in that the air nozzle fitting 66 of the air dispenser 18 may be variably pivoted relative to the barrel 50 of the air dispenser 18 to alter the direction of the air flow expelled from the from the nozzle orifice 68 of the air nozzle fitting 66.

In FIG. 6, the input gas port 58 of the air dispenser 18 is connected to an air line 46*a* that is in direct flow communication with the output of a graduated pressure operated gas valve (not shown) in the foot pedal 24*a* of the remote control unit 20*a*. The input gas port of the graduated pressure operated gas valve in the is in direct flow communication with the bottle output valve (not shown) of a bottle-type gas pressure reservoir 14*a*.

Figure 4:
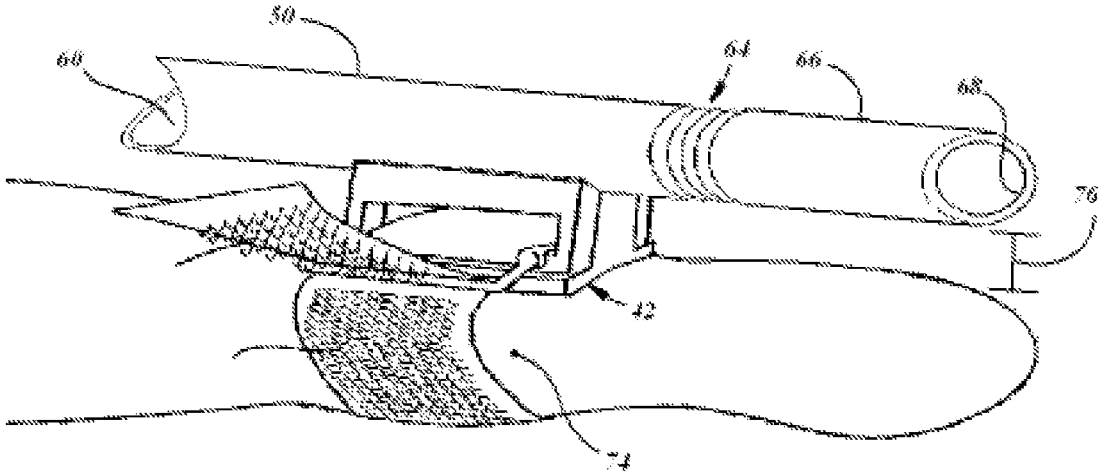
FIG. 4 is a schematic diagram illustrating use of a hook and loop strap mount as an alternative mount for attaching the air dispensing unit to a user's (gloved) finger.
Figure 5:
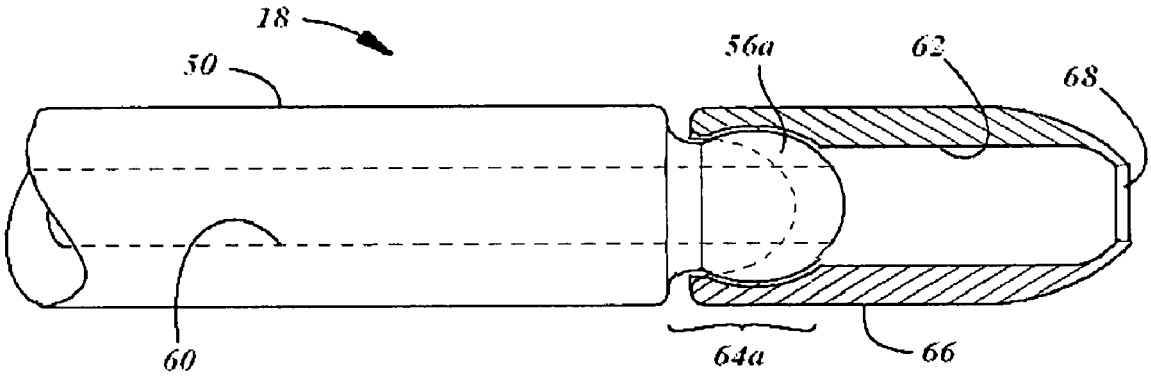
FIG. 5 is a partial cross-sectional diagram of the nozzle end of the air dispensing unit showing laterally pivotable ball-and-socket joint connecting the air nozzle to the barrel of the air dispensing unit.

In the preferred embodiments shown, the barrel 50 of the air dispenser 18 comprised a hollow cylindrical tube that attached to a finger of the user' hand, typically the index finger. The barrel 50 of the air dispenser 18 is attached to the user's finger by any of a number of mounting means known to and selectable by one of ordinary skill in the art for practice in the present invention. For example, In FIG. 3, the mounting means is a finger ring mount 40, and in FIG. 4, the mounting means comprises a finger strap mount 42. As a further example, the barrel 50 may be mounted to the finger of a glove, which the user wears. The mounting means holds the barrel 50 of the air dispenser 18 in a relatively stable relationship to the finger joint 74 of the user's hand 72 to which it is attached. This allows the user to move the hand without having drag from the mass of the airline 46 altering the relationship of the barrel 50 to the finger joint of the user. Typically, the this relationship will be that the line of the gas flow passage 60 of the barrel 50 will be in line with the joint bone of the finger joint 74.

Figure 8A:
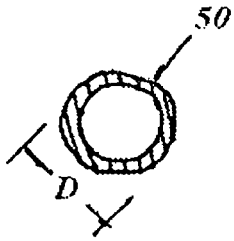
FIGS. 8A and 8B are cross-sectional views of alternative embodiments of the barrel portion of the air dispenser of the present invention.

In the preferred embodiments, the exterior diameter D of the barrel 50 is not larger than the width of the finger joint 74 on which it is mounted, see FIG. 8A. In the embodiments illustrated, mounting the air dispenser to the users finger is accomplished a wide band finger ring 40, and alternatively with a hook & loop strap mount 42 snugly wrapped around the finger joint 74. A portion of the air line 60 may attached to another finger joint or to the hand or wrist of the user to reduce of eliminate the possibility that the air line 60 will drag on the air dispenser 18 during movement of the user's hand 72. However attachment is accomplished, mounting of the air dispenser 18 the user's finger should not interfere with the user's ability to bend the finger or to otherwise hamper the dexterity of the user.

The barrel 50 portion of the air dispenser 18 typically will be at least semi-rigid in view of its intended use and alignment with the finger joint. The material configuration of the barrel 50 should allow it to facilitate accurate directional control of the airflow by the user pointing the finger to which it is mounted. The nozzle fitting 66 preferably should be soft to the touch (or covered with a soft material) in view of its use proximate a person's eye. An acceptable material for this purpose is foam rubber. However, the nozzle fitting 66 must be rigid enough to maintain directional control of the airflow. The final positioning of the barrel mount 40 on the finger, the air dispenser 18 on the mount 40 and the air flow port 68 of the nozzle fitting 66 is adjustable by the user to satisfy the user's individual dexterity, and comfort. For example, there can be a gap 76 between the end of the user's finger and the air flow port 68 of the of the nozzle fitting 66, such that the tip of the air flow port 68 extends beyond the user's finger tip. The purpose of the gap 76 is to limit any interference in the airflow by the user's finger tip. A typical gap 76 can be between one-quarter inch and one half inches.

In use of the preferred embodiments, the assembled, the air source 14 provides an appropriate steady stream of air flow at the nozzle port 68 of the air dispenser 18. Control of the air flow is accomplished using the remote control unit 20. The preferred control unit 20 illustrated comprises a foot pedal and is operated by pressure transmitted to the unit's graduated pressure switch or valve by the user's foot. Use of a foot pedal control unit enables the hands-free operation of the present low pressure air source 10. The graduated pressure switch/valve is normally biased off/closed, so that removing the user's foot from the control unit 20 turns off the flow of air. Also, preferably the pressure switch/valve is adapted so that increasing the pressure on the switch causes an increase in the pressure and/or flow of air from the nozzle port 68.

Figure 8B:
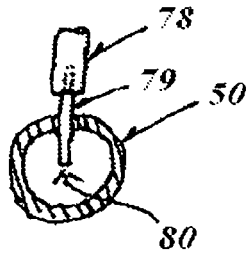

As shown in FIG. 8B, additives 80 can be introduced to the airflow within the barrel 50 of the air dispenser 18, by utilizing an optional venturi tube 78 inserted into a venturi port 79 on the barrel 50, much as might be found on an air brush dispenser unit. Such additives 80 may include water, as water improves the curing of the certain adhesive compositions. Another additive may be an oil-based sealant, which seals the lash extensions precluding staining or discoloration.

To use the present low pressure air source 10, the user attaches the barrel 50 of the air dispenser 18 to a finger joint 74, as illustrated herein. Air lines 46 connect the air dispenser 18 to the air source 14. The air line 46 proximate the air dispenser 18 may be attached to the user's wrist to prevent interference of the air line 46 with the user's hand operations. Airflow is adjusted to provide light air pressure at the nozzle port 68 of the nozzle fitting 66.

Then, the index finger and the thumb of the user's first hand 72 are able to grasp a forcipes or other instrument as may be used in the process. Airflow is directed by the finger lengthwise down an eyelash. The airflow separates the individual eyelashes from each other. Using a forcipes held in the other hand, the user pinches the isolated eyelash against a support patch precluding further movement of that isolated eyelash. Using the first hand, the user selects an extension from a cache, and dips the end of the extension into an adhesive. The user then takes the extension and applies it to the isolated individual eyelash. Once the adhesive sets, usually within a few seconds, the user directs a burst of airflow over the adhesive to more fully cure the adhesive. The airflow accelerates the curing of the adhesive and decreases the time required for the application of a complete set of extensions.

A further benefit to the device is that a smooth and constant application of the extensions can occur without the user having to set down the instruments or to change hands holding the instruments to use the air source 10. The smooth and constant application of extensions significantly decreases the time required for a complete set of extensions.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. An apparatus for providing directional and variable airflow comprising:

a hollow cylindrical tube having an input end and a nozzle end;

a means of securing said cylindrical tube to a finger of a favored-hand;

a low pressure air source;

a tube connecting the input end of said cylindrical tube to the air source;

wherein said air source provides variable air pressure within the cylindrical tube and airflow at the nozzle end of the cylindrical tube;

wherein said variable air pressure is controlled with a foot switch;

wherein said nozzle end of said cylindrical tube is semi-rigid;

wherein said means of securing said cylindrical tube to a finger provides a beautician with directional control of said airflow.

* * * * *